United States Patent [19]

Smith

[11] 4,259,656

[45] Mar. 31, 1981

[54] THERMAL CUT-OFF DEVICE WITH AN ACTIVATING SPRING THAT IS HELD IN A PRESTRESSED CONDITION BY A THERMALLY FUSIBLE PELLET

[75] Inventor: Dennis D. Smith, Bartlett, Ill.

[73] Assignee: Illinois Tool Works Inc., Chicago, Ill.

[21] Appl. No.: 37,970

[22] Filed: May 11, 1979

[51] Int. Cl.[3] ..... H01H 37/36

[52] U.S. Cl. ..... 337/407; 337/403

[58] Field of Search ..... 337/407, 408, 409, 401, 337/410, 411, 403, 404, 405

[56] References Cited

U.S. PATENT DOCUMENTS

| | | | |
|---|---|---|---|
| 672,266 | 4/1901 | Gardner | 337/401 |
| 1,199,654 | 9/1916 | Bailey | 337/412 |
| 1,685,136 | 9/1928 | Montgomery | 337/409 |
| 2,049,193 | 7/1936 | Bullen | 337/407 |
| 4,001,754 | 1/1977 | Plasko | 337/407 |

FOREIGN PATENT DOCUMENTS

| | | | |
|---|---|---|---|
| 617502 | 2/1927 | France | 337/407 |
| 831737 | 3/1960 | United Kingdom | 337/407 |

*Primary Examiner*—Harold Broome

*Attorney, Agent, or Firm*—Thomas W. Buckman; Glenn W. Bowen

[57] ABSTRACT

A thermal cut-off device is disclosed in which a first axial lead extends through an insulating member at one end of the device and a second axial lead contacts and extends through a conductive cylindrical housing at the other end of the device. A domed electrical contact cup is used in one embodiment to make electrical connection between the insulated lead and the outer metallic housing, and this electrical connection is maintained by a coiled helical spring. One end of the coiled spring is larger in diameter than the other end. The large diameter end is in engagement with the end of the conductive housing through which the second axial lead projects, while the smaller end of the conductive spring is in engagement with the insulated first axial lead, either directly or through the domed contact cup. The spring is held in a prestressed condition by a solid thermally fusible or meltable pellet which surrounds the spring, and which holds it in its stressed condition until the predetermined melting, or fusible, temperature of the pellet is reached at which time the stress is relieved in the spring and it contracts away from the insulated first axial lead, so as to break electrical connection between the leads of the device.

4 Claims, 6 Drawing Figures

Fig. 6
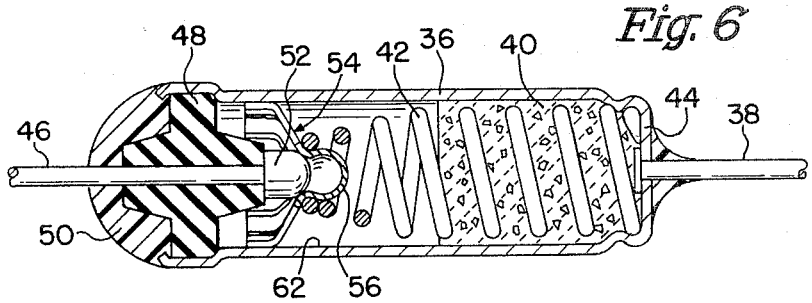
Fig. 7
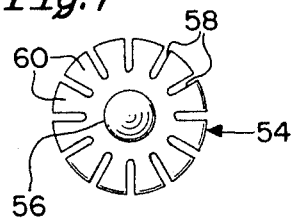
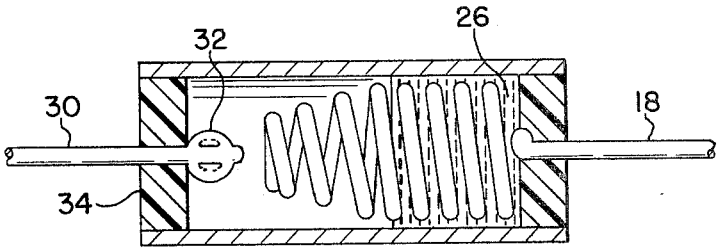
Fig. 5
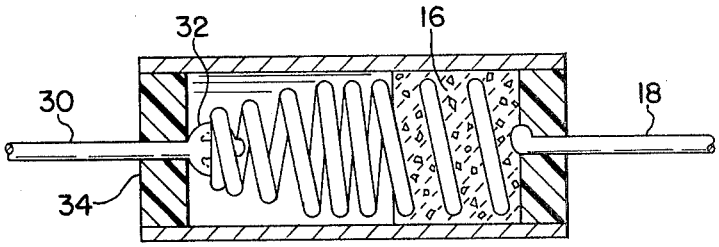
Fig. 4
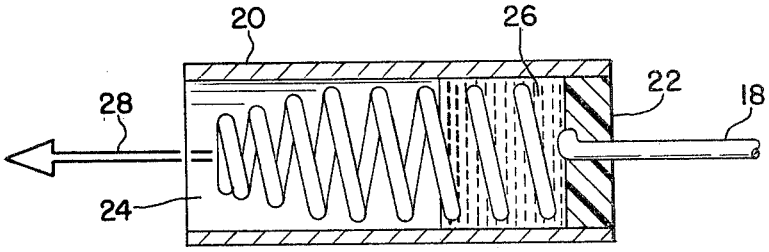
Fig. 3
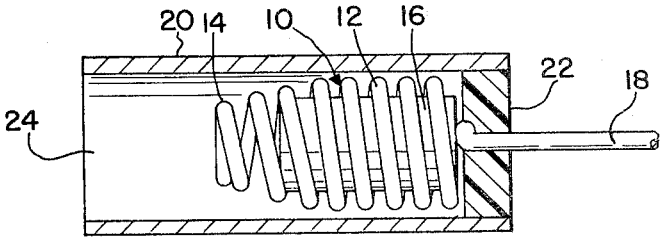
Fig. 2
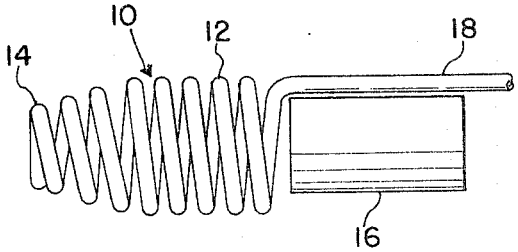
Fig. 1

THERMAL CUT-OFF DEVICE WITH AN ACTIVATING SPRING THAT IS HELD IN A PRESTRESSED CONDITION BY A THERMALLY FUSIBLE PELLET

DESCRIPTION OF THE DRAWINGS

The present invention is described by reference to the drawings in which:

FIGS. 1–5 illustrate the method of making the thermal cut-off device of the present invention;

FIG. 6 represents a completed cross-sectional view of a preferred embodiment of the present invention; and FIG. 7 shows the domed contact cup which is employed in the embodiment of FIG. 6.

TECHNICAL DESCRIPTION OF THE INVENTION

The construction of the simplified version of the present invention is illustrated in FIGS. 1–5 of the drawings with the first step of the assembly being shown in FIG. 1, and with the processing steps progressing upwardly through FIG. 5. FIG. 1 shows a coiled open helical spring 10 which has a large diameter end 12 and a smaller diameter end 14. The open coil of the spring 10 allows for the insertion of a thermally sensitive pellet 16 which melts, or fuses, at a predetermined selected temperature. The pellet 16 is inserted into the large open end 12 of the coiled spring 10 as shown in FIG. 2. At the open end of the coil, the terminal end of the coil is straightened and extends outwardly to form one lead of the device.

The cylindrical tube housing 20 is made of ceramic or other insulating material and is inserted over the pellet and the spring 10. An electrically insulating plug 22 fits the right hand open end of the cylindrical tube 20 which is shown in FIG. 2. The elongated lead end 18 of the spring 10 extends through the plug 22. In FIGS. 1 through 5 the right hand end where the plug 22 is inserted should be considered to be the bottom of the assembly, with the open end 24 the top of the assembly. The reason for this is that in the production of the device the pellet is first melted, and is then in molten state, as shown by the molten mass 26 of FIG. 3. In order to keep the molten mass 26 against the plug 22, it is preferable to maintain the plug 22 below the open end 24 so that gravity may perform this function, although, of course, air pressure emitted into the open end 24 could also achieve the desired result.

During the time the mass of the pellet is in the molten state, the coiled spring is stretched as indicated by the line 28 which schematically represents the application of a force to the small end 14 of the spring. While this force is maintained on the small end of the spring, so as to elongate the spring, a second lead 30 with an enlarged contact portion 32 is positioned in the housing 20 of the device. A second electrical insulating plug 34 through which the leads 30 extends closes off the end 24. When the pellet mass again solidifies to reform the pellet 16 and the force on the spring is released, the spring 10 will be held in its stressed state by the intimate surrounding condition of the solid mass of the pellet so that electrical contact is maintained between the leads 30 and 18 through the stressed spring. Thus, when the predetermined melting, or fusible, temperature of the pellet is again reached, the pellet will again go to its molten state and the locked-in stress on the spring 10 will be relieved so that the circuit connection between the leads 30 and 18 will thereby be broken, as shown in FIG. 5.

The described embodiment shown in connection with FIGS. 1–5 represents one version of the present invention in which an insulated housing is provided. An alternate and preferable embodiment is shown in cross-sectional form in FIG. 6. In this version the housing 36 is a cylindrical can which is made of conductive material and in which the lead 38 is secured in contact with the metal can. The pellet 40 again holds the prestressed spring 42 in its stressed state with the pellet being located against the wall 44 through which the lead 38 projects. In this embodiment, the lead 46 extends through an insulating member 48 and an epoxy seal 50 is preferably employed to seal off the open end of the housing 36. An enlarged head 52 is formed on the insulated lead 46. A separate domed spring contact cup 54 with an enlarged spherical-shaped dome 56 is forced into engagement with the head 52. The spherical-shaped dome 56 acts as a spring receiving post that is inserted and retained into the open coils at the smaller diameter end section 56 of the coil spring 42.

As shown in FIG. 7, the domed contact cup 54 has a plurality of slots 58 cut into it to form a plurality of individual contact fingers 60 which resiliently engage the inner side wall 62 of the conductive housing, thereby providing good electrical contact between the leads 46 and 38 through both the spring 42 and the conductive housing 36.

The manner of assembly and operation of the thermal cut-off device of FIG. 6, is the same as that shown and described in conjunction with FIGS. 1–5. When the pellet 40 melts in the device of FIG. 6, the spring 42 will, therefore, be relieved of stress and it will move the domed control cup 54, which is located against the head 52 of the lead 46 and against the inner wall 62 of the housing 36.

What is claimed is:

1. A thermal cut-off device comprising first and second axial leads, a cylindrical shaped housing for said device, means for supporting said axial leads at spaced apart positions at opposite ends of said housing, helical coiled spring means making electrical connection between said leads when said spring is subject to a prestressed tension that tends to elongate said spring with one end of said spring being permanently secured to said first lead and the other end of said spring being in contact with said second lead only as long as said spring is subject to said prestressed tension, and a thermally fusible pellet means constructed to melt at a predetermined temperature which intimately surrounds a portion of said spring means adjacent said first lead and retains said spring means when said spring means is in said prestressed tension condition until such time that said thermally sensitive pellet means melts, at which time said prestressed tension on said spring means is released and said electrical circuit between said leads is broken by the contraction of said spring means toward said first lead, wherein said housing is a metallic conductive can that is open at one end and is connected at its other end to a first one of said leads, an insulating member in said open end of said housing through which the second one of said leads passes, and a domed spring contact cup in contact with said first lead having spring fingers that are in resilient contact with the inner cylindrical wall of said housing, said spring cap contact means also having an enlarged dome which is inserted into the inner coils of said prestressed spring so as to make electrical contact therewith.

2. A thermal cut-off device as claimed in claim 1 wherein said prestressed spring is a coiled helical spring that has a large diameter end and a small diameter end and said large diameter end in contact with the end of the metallic can which is connected to said second lead and the smaller diameter end of said spring projects towards the open end of said can and makes contact with said dome.

3. A thermal cut-off device comprising first and second axial leads, a cylindrical shaped housing for said device, means for supporting said axial leads at spaced apart positions at opposite ends of said housing, helical coiled spring means making electrical connection between said leads when said spring is subject to a prestressed tension that tends to elongate said spring with one end of said spring being permanently secured to said first lead and the other end of said spring being in contact with said second lead only as long as said spring is subject to said prestressed tension, and a thermally fusible pellet means constructed to melt at a predetermined temperature which intimately surrounds a portion of said spring means adjacent said first lead and retains said spring means when said spring means is in said prestressed tension condition until such time that said thermally sensitive pellet means melts, at which time said prestressed tension on said spring means is released and said electrical circuit between said leads is broken by the contraction of said spring means toward said first lead, wherein said housing is a metallic conductive can that is open at one end and is connected at its other end to a first one of said leads, an insulating member in said open end of said housing through which the second one of said leads passes, and a domed spring contact cup in contact with said first lead having spring fingers that are in resilient contact with the inner cylindrical wall of said housing, said spring cap contact means also having an enlarged dome which is inserted into the inner coils of said prestressed spring so as to make electrical contact therewith.

4. A thermal cut-off device as claimed in claim 3 wherein said prestressed spring is a coiled helical spring that has a large diameter end and a small diameter end and said large diameter end in contact with the end of the metallic can which is connected to said second lead and the smaller diameter end of said spring projects towards the open end of said can and makes contact with said dome.

* * * * *